US010618094B2

(12) United States Patent
Martin Gonzalez et al.

(10) Patent No.: US 10,618,094 B2
(45) **Date of Patent: *Apr. 14, 2020**

(54) PRESS SYSTEMS AND METHODS

(71) Applicant: AUTOTECH ENGINEERING S.L., Amorebieta-Etxano (ES)

(72) Inventors: Ignacio Martin Gonzalez, Sant Pere de Ribes (ES); Manuel López Lage, Abrera (ES); Pedro Raya Zamora, Sant Quirze del Valles (ES)

(73) Assignee: AUTOTECH ENGINEERING S.L., Amorebieta-Etxano (ES)

( * ) Notice: Subject to any disclaimer, the term of this patent is extended or adjusted under 35 U.S.C. 154(b) by 172 days.

This patent is subject to a terminal disclaimer.

(21) Appl. No.: 15/556,263

(22) PCT Filed: Mar. 8, 2016

(86) PCT No.: PCT/EP2016/054885
§ 371 (c)(1),
(2) Date: Sep. 6, 2017

(87) PCT Pub. No.: WO2016/142367
PCT Pub. Date: Sep. 15, 2016

(65) Prior Publication Data

US 2018/0050378 A1 Feb. 22, 2018

(30) Foreign Application Priority Data

Mar. 9, 2015 (EP) ..... 15382104

(51) Int. Cl.
*B21D 37/16* (2006.01)
*B21D 22/02* (2006.01)
(Continued)

(52) U.S. Cl.
CPC ..... *B21D 22/022* (2013.01); *B21D 22/208* (2013.01); *B21D 37/16* (2013.01); *C21D 1/673* (2013.01)

(58) Field of Classification Search
CPC .... B21D 22/20; B21D 22/206; B21D 22/208; B21D 22/30; B21D 24/005; B21D 37/16; B21D 22/02; B21D 22/022; C21D 1/673
See application file for complete search history.

(56) References Cited

U.S. PATENT DOCUMENTS 8,272,245 B2 9/2012 Salamon et al.
9,321,092 B2 4/2016 Takasue et al.
(Continued)

FOREIGN PATENT DOCUMENTS

CN 1930311 A 3/2007
CN 102676767 A 9/2012
(Continued)

OTHER PUBLICATIONS

Translation, JP 2005-131665A, May 2005.*
(Continued)

*Primary Examiner* — Edward T Tolan
(74) *Attorney, Agent, or Firm* — Squire Patton Boggs (US) LLP

(57) ABSTRACT

Press systems for manufacturing hot formed structural components may be provided. The systems comprise a fixed lower body (2), a mobile upper body (3) and a mechanism configured to provide upwards and downwards press progression of the mobile upper body (3) with respect to the fixed lower body (2). The system further comprises a cooling/heating tool (10) configured to cool down and/or heat a previously heated blank having locally different microstructures and mechanical properties which comprises: upper (11) and lower (12) mating dies, and the upper (11)
(Continued)

and lower (12) dies comprising two or more die blocks adapted to operate at different temperatures corresponding to zones of the blank having locally different microstructures and mechanical properties, and a press tool (20) configured to draw the blank, wherein the press tool (20) is arranged downstream the cooling/heating tool (10). Moreover, methods for hot forming structural components are also provided.

15 Claims, 7 Drawing Sheets

(51) Int. Cl.
*B21D 22/20* (2006.01)
*C21D 1/673* (2006.01)

(56) References Cited

U.S. PATENT DOCUMENTS

| | | | | |
|---|---|---|---|---|
| 9,469,891 | B2 * | 10/2016 | Okita | B21D 22/208 |
| 9,492,859 | B2 | 11/2016 | Gonzalez et al. | |
| 2010/0095733 | A1 | 4/2010 | Salamon et al. | |
| 2013/0111966 | A1 | 5/2013 | Takasue et al. | |
| 2013/0312474 | A1 | 11/2013 | Dykstra | |
| 2014/0020795 | A1 | 1/2014 | Schwinghammer et al. | |
| 2014/0338802 | A1 | 11/2014 | Okita et al. | |
| 2015/0075246 | A1 * | 3/2015 | Dorr | B21D 22/201 72/347 |
| 2016/0059295 | A1 * | 3/2016 | Frost | B21D 22/02 72/354.6 |
| 2016/0228934 | A1 * | 8/2016 | Frost | B21D 22/208 |

FOREIGN PATENT DOCUMENTS

| | | | | |
|---|---|---|---|---|
| CN | 103003003 | A | 3/2013 | |
| CN | 103826771 | | 5/2014 | |
| DE | 10 2005 032113 | B3 | 2/2007 | |
| DE | 10 2008 039264 | A1 | 3/2010 | |
| DE | 10 2009 012940 | A1 | 9/2010 | |
| DE | 102009014670 | A1 | 9/2010 | |
| DE | 102009057382 | A1 | 6/2011 | |
| DE | 10 2011 011013 | A1 | 8/2012 | |
| DE | 102013100682 | B3 | 6/2014 | |
| EP | 2 324 938 | A1 | 5/2011 | |
| EP | 2 595 770 | A0 | 1/2012 | |
| EP | 2 762 243 | A1 | 8/2014 | |
| EP | 3 067 128 | A1 | 9/2016 | |
| FR | 2 927 828 | A1 | 8/2009 | |
| JP | 2006-344200 | | 12/1994 | |
| JP | 2003-053437 | | 2/2003 | |
| JP | 2005-131665 | A * | 5/2005 | B21D 22/20 |
| JP | 2007-136533 | | 6/2007 | |
| JP | 2007-144495 | | 6/2007 | |
| JP | 2010520058 | A | 6/2010 | |
| KR | 2011/0075732 | | 7/2011 | |
| KR | 20140056734 | A | 5/2014 | |
| SU | 1234006 | A1 | 5/1986 | |
| SU | 1292877 | A1 | 2/1987 | |
| WO | WO 2010/150683 | A1 | 12/2010 | |
| WO | WO 2011/115539 | A1 | 9/2011 | |
| WO | WO 2013/047526 | | 4/2013 | |

OTHER PUBLICATIONS

International Search Report and Written Opinion dated Sep. 13, 2018, for International Application No. PCT/EP2018/071064, 9 pages.
Exteneded European Search Report dated Feb. 1, 2018 for European Application No. 17382531.6, 7 pages.
European Search Report dated Sep. 1, 2015, for European Patent Application No. 15 38 2103, 4 pp.
International Search Report dated May 10, 2016, for International Application No. PCT/EP2016/054885, 13 pp.

* cited by examiner

PRESS SYSTEMS AND METHODS

The application claims the benefit of the European Patent Application EP15382104.6 filed on Mar. 9, 2015.

The present disclosure relates to press systems for manufacturing hot formed structural components and methods therefor.

BACKGROUND

The demand for weight reduction in the automotive industry has led to the development and implementation of lightweight materials or components, and related manufacturing processes and tools. The demand for weight reduction is especially driven by the goal of reduction of $CO_2$ emissions. The growing concern for occupant safety also leads to the adoption of materials which improve the integrity of the vehicle during a crash while also improving the energy absorption.

A process known as Hot Forming Die Quenching (HFDQ) uses boron steel sheets to create stamped components with Ultra High Strength Steel (UHSS) properties, with tensile strengths of e.g. 1.500 MPa or 2000 MPa or even more. The increase in strength allows for a thinner gauge material to be used, which results in weight savings over conventionally cold stamped mild steel components.

There are several known Ultra High Strength steels (UHSS) for hot stamping and hardening. The blank may be made e.g. of a boron steel, coated or uncoated, such as Usibor® (22MnB5) commercially available from ArcelorMittal.

Typical vehicle components that may be manufactured using the HFDQ process include: door beams, bumper beams, cross/side members, NB pillar reinforcements, and waist rail reinforcements.

Hot forming of boron steels is becoming increasingly popular in the automotive industry due to their excellent strength and formability. Many structural components that were traditionally cold formed from mild steel are thus being replaced with hot formed equivalents that offer a significant increase in strength. This allows for reductions in material thickness (and thus weight) while maintaining the same strength. However, hot formed components offer very low levels of ductility and energy absorption in the as-formed condition.

In order to improve the ductility and energy absorption in specific areas of a component, it is known to introduce softer regions within the same component. This improves ductility locally while maintaining the required high strength overall. By locally tailoring the microstructure and mechanical properties of certain structural components such that they comprise regions with very high strength (very hard) and regions with increased ductility (softer), it may be possible to improve their overall energy absorption and maintain their structural integrity during a crash situation and also reduce their overall weight. Such soft zones may also advantageously change the kinematic behaviour in case of a collapse of a component under an impact.

Known methods of creating regions with increased ductility ("softzones" or "soft zones") in vehicle structural components involve the provision of tools comprising a pair of complementary upper and lower die units, each of the units having separate die elements (steel blocks). A blank to be hot formed is previously heated to a predetermined temperature e.g. austenization temperature or higher by, for example, a furnace system so as to decrease the strength i.e. to facilitate the hot stamping process.

The die elements may be designed to work at different temperatures, in order to have different cooling rates in different zones of the part being formed during the quenching process, and thereby resulting in different material properties in the final product e.g. soft areas. E.g. one die element may be cooled in order to quench the corresponding area of the component being manufactured at high cooling rates and by reducing the temperature of the component rapidly. Another neighbouring die element may be heated in order to ensure that the corresponding portion of the component being manufactured cools down at a lower cooling rate, and thus remaining at higher temperatures than the rest of the component when it leaves the die.

The use of multistep press systems for manufacturing hot formed elements is known. The multistep press systems may comprise a plurality of tools configured to perform different operations on blanks simultaneously. With such arrangements, a plurality of blanks undergo different manufacturing processes simultaneously during one stroke using the tools forming the multistep press systems, thus the performance of the system may be increased.

A multistep press system may include a conveyor or a transferring device which transfers the heated blank to a press tool which is configured to press the blank. Additionally, a furnace system that heats and softens the blank to be hot formed may be provided upstream from the multistep press machine. Furthermore, a separate laser process step or a separate cutting tool may also be provided, wherein the stamped blanks are discharged from the press system and are transferred and located into the laser process step or in the separate cutting tool in order to be manufactured e.g. cut and/or trimmed and/or pierced and/or punched.

Generally, in such systems, an external pre-cooling tool is used in order to previously cool down the blank to be hot formed. Once the blank is cooled down, it is transferred from the external pre-cooling tool to the multistep press apparatus or system.

WO2011115539 describes a contact-cooling press provided between a furnace and a press-hardening press. Preselected parts of a blank (18) are contact-cooled such that corresponding parts of the finished product are softer and display a higher yield point.

The present disclosure seeks to provide improvements in multistep systems configured to create soft zones and methods.

SUMMARY

In a first aspect, a press system for manufacturing hot formed structural components may be provided. The system comprises a fixed lower body, a mobile upper body and a mechanism configured to provide upwards and downwards press progression of the mobile upper body with respect to the fixed lower body. The system further comprises a cooling/heating tool configured to cool down and/or heat a previously heated blank having locally different microstructures and mechanical properties which comprises: upper and lower mating dies, each cooling die being formed by two or more die blocks comprising one or more working surfaces that in use face the blank, and the upper and lower dies comprising two or more die blocks adapted to operate at different temperatures corresponding to zones of the blank having locally different microstructures and mechanical properties, and a press tool configured to draw the blank, wherein the press tool is arranged downstream from the cooling/heating tool and comprises upper and lower mating dies, each pressing die comprising one or more working surfaces that in use face the blank, and the upper pressing die is fastened to the upper body and the lower pressing die is fastened to the lower body. The system further comprises a blank transfer mechanism to transfer the blank from the cooling/heating tool to the press tool.

According to this aspect, a press system is provided with a cooling/heating tool adapted to create zones of the blank having locally different microstructures and mechanical properties ("soft zones") and a drawing or forming tool.

With such a cooling/heating tool, selected die blocks may be heated up, thus the different microstructures and mechanical properties of the blank in the area in contact with the heated block ("soft zone") may be changed, thus improving the ductility of zones.

In addition, with the integration of the tools in a single press, the transfer time from the cooling tool to the drawing tool may be reduced, thus the process may be optimized and the productivity may be improved while maintaining the temperature and the cooling rate under control.

In a second aspect, a method for heating and cooling of a blank may be provided. The method comprises: providing a press system according to the first aspect. The method further includes providing a blank to be hot formed made of an Ultra High Strength Steel (UHSS). The blank may be heated. The press upper body is located at an open position using the press mechanism. Then, the blank is placed between the cooling/heating tool upper and lower mating dies. At least portions of the blank are cooled down by providing a downwards press progression of the mobile upper body with respect the fixed lower body so as the upper die is moved towards the lower die until a final desired position with respect to the fixed lower body for pressing the blank is reached, including the least two die blocks may be operated at different temperatures corresponding to zones of the blank to be formed having locally different microstructures and mechanical properties, wherein blocks of a higher temperature are arranged with respect to the blank such that their working surface is configured to enter into contact with a portion of the blank in which a soft zone is to be formed.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1:
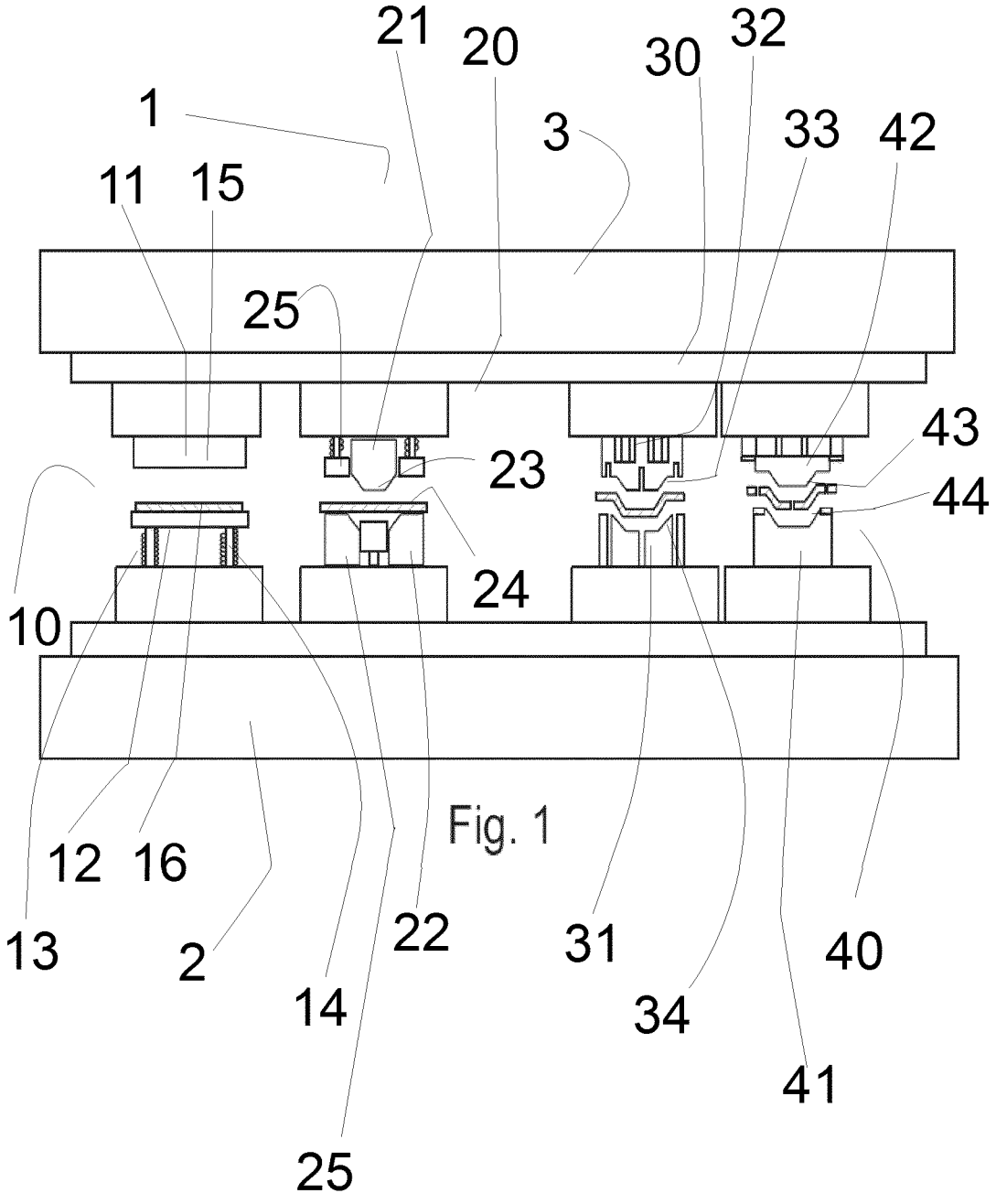
FIG. 1 schematically represents a multistep press system according to an example.

FIG. 1 schematically represents a multistep press system according to an example. The system 1 comprises a fixed lower body 2, a mobile upper body 3 and a mechanism (not shown) configured to provide upwards and downwards press progression of the mobile upper body 3 with respect to the fixed lower body 2.

The fixed lower body 2 may be a large block of metal. In this particular example, the fixed lower body 2 may be stationary. In some examples, a die cushion (not shown) integrated in fixed lower body 2 may be provided. The cushion may be configured to receive and control blank holder forces. The mobile upper body 3 may also be a solid piece of metal. The mobile upper body 3 may provide the stroke cycle (up and down movement).

The press system may be configured to perform approximately 30 strokes per minute, thus each stroke cycle may be of approximately 2 seconds. The stroke cycle could be different in further examples.

The mechanism of the press may be driven mechanically, hydraulically or servo mechanically. The progression of the mobile upper body 3 with respect to the fixed lower body 2 may be determined by the mechanism. In this particular example, the press may be a servo mechanical press, thus a constant press force during the stroke may be provided. The servo mechanical press may be provided with infinite slide (ram) speed and position control. The servo mechanical press may also be provided with a good range of availability of press forces at any slide position, thus a great flexibility of the press may be achieved. Servo drive presses may have capabilities to improve process conditions and productivity in metal forming. The press may have a press force of 2000 Tn.

In some examples, the press may be a mechanical press, thus the press force progression towards the fixed lower body 2 may depend on the drive and hinge system. Mechanical presses therefore can reach higher cycles per unit of time. Alternatively, hydraulic presses may also be used.

A cooling/heating tool 10 configured to cool down and heat up previously selected parts of a blank may be provided. The blank may be previously heated, for example, in a furnace. The cooling/heating tool 4 may comprise upper 11 and lower 12 mating dies. Each cooling tool upper 11 and lower 12 die may be formed by two or more die blocks (not shown). The cooling/heating tool upper die comprises an upper working surface 15. The cooling/heating tool lower die comprises a lower working surface 16. Both working surfaces in use face the blank to be hot formed.

The die blocks (not shown in detail) may be adapted to operate at different temperatures corresponding to zones of the blank which are to obtain locally different microstructures and mechanical properties ("soft zones" and "hard zones"). The die blocks adapted to operate at lower temperature may correspond to zones of the blank in which "hard zones" are to be formed. Moreover, the die blocks adapted to operate at higher temperature may thus correspond to zones of the blank in which "soft zones" are to be formed.

The selection of the soft zones may be based on crash testing or simulation test although some other methods to select the soft zones may be possible. The soft zone areas may be defined by simulation in order to determine the most advantageous crash behaviour or better absorptions in a simple part such as e.g. a B-pillar.

The lower die 12 may be connected to the lower body 2 with a first lower biasing element 13 and a second lower biasing element 14 configured to bias the lower die 12 to a position at a predetermined first distance from the lower body 2. The biasing elements may comprise, for example, a spring e.g. a mechanical spring or a gas spring although some other biasing elements may be possible e.g. hydraulic mechanism. In some examples, a single lower biasing element or more than two biasing elements may be provided In some other examples (not illustrated), alternatively or additionally the upper die 11 may be connected to the upper body 3 with one or more upper biasing elements configured to bias the upper die in a position at a predetermined second distance from the upper body.

In yet further examples, the lower die 12 may be directly connected to the lower body 2 and/or the upper die 11 may be directly connected to the upper body 3, thus no biasing element may be needed.

With the insertion of the upper and/or lower biasing elements, the contact time between the upper die 11 and the lower die 12 may be regulated and increased during a stroke cycle (up and down movement of the mobile upper body 3 with respect to the lower body 2).

Due to the biasing elements in the cooling/heating tool, the contact between the upper and lower cooling dies may be produced before the contact of the pressing dies of the pressing tool (and further tools arranged downstream). Thus, contact time between the cooling dies during a stroke cycle may be increased allowing more cooling of the portions to be cooled.

The die blocks of the cooling tool may comprise a heating source e.g. electrical heaters and/or channels conducting a hot liquid in order to achieve higher temperatures ("hot block"). Other alternatives for adapting the dies to operate at higher temperatures may also be foreseen, e.g. embedded cartridge heaters.

Additionally, the upper and lower dies may include one or several blocks adapted to operate at a lower temperature ("cold block"). These cold blocks may be cooled with a cooling liquid e.g. water and/or air passing through channels provided in the block.

Additionally, the cooling/heating tool 10 may be provided with a control system and temperature sensors to control the temperature of the hot and/or cold blocks. The sensors may be thermocouples.

Each thermocouple may define a zone of the tool operating at a predefined temperature. Furthermore, each thermocouple may be associated with a heater or group of heaters in order to set the temperature of that zone.

The thermocouples may be associated with a control panel. Each heater or group of heaters (or cooling devices) may thus be activated independently from the other heaters or group of heaters even within the same block. Thus using a suitable software or control logic, a user will be able to set the key parameters (temperature, temperature limits) based on which heater power, water flow on/off, water flow rate etc. can be regulated in an automated manner of each zone within the same block.

Furthermore, the upper 11 and/or lower 12 mating dies may be provided with a cooling plate (not shown) configured to avoid overheating of the hot blocks which may be located at the surfaces opposite to the upper working surface 15 and/or the lower working surface 16 comprising a cooling system arranged in correspondence with each die respectively. The cooling system may comprise cooling channels for circulation of cold water or any other cooling fluid in order in order to avoid or at least reduce heating of the cooling/heating tool or to provide an extra cooling to the cooling/heating tool.

In examples, the cooling/heating tool may be provided with centering elements e.g. pins and/or guiding devices configured to locate properly the blank on the tool. In some other examples, the blank may be previously situated at a centering station e.g. a gravity table to get the blank centered. Alternatively, the blank may be located using e.g. a vision system.

A press tool 20 configured to draw the blank is also provided in this example. The press tool 20 is arranged downstream the cooling/heating tool 10. The press tool 20 comprises upper 21 and lower 22 mating dies.

The press tool upper 21 and lower 22 dies comprise two or more die blocks adapted to operate at different temperatures corresponding to zones of the blank that ultimately are to obtain locally different microstructures and mechanical properties ("soft zones"). The blocks may correspond with the corresponding soft zones or hard zones created at the cooling/heating tool.

The upper die blocks may comprise an upper working surface 23 that in use faces the blank to be hot formed. The lower die blocks may comprise a lower working surface 24 that in use faces the blank to be hot formed.

A side of the upper die opposite to the upper working surface 23 may be fastened to the upper body 3 and a side of the lower die opposite to the lower working surface 22 may be fastened to the lower body 2.

The upper 21 and lower 22 dies may include one or several blocks adapted to operate at a lower temperature ("cold block"). These cold blocks may be cooled with a cooling liquid e.g. water and/or air passing through channels provided in the block.

In the water channels, the speed of circulation of the water at the channels may be high, so that water evaporation may be avoided. A control system may be further provided, thus the temperature of the blocks may be controlled.

In addition, the upper 21 and lower 22 dies may include one or several blocks adapted to operate at a higher temperature ("hot block"). The "hot blocks" may comprise one or more electrical heaters and temperature sensors to control the temperature of the "hot blocks". The sensors may be thermocouples. Each thermocouple may define a zone of the tool operating at a predefined temperature. Furthermore, each thermocouple may be associated with a heater or group of heaters in order to set the temperature of that zone. The total amount of power per zone (block) may limit the capacity of grouping heaters together.

The remaining structure and operation of the blocks adapted at a higher temperature may be the same as mentioned for the cooling/heating tool. Furthermore, the upper 21 and/or lower 22 mating dies may be provided with a cooling plate (not shown) which may be located at the surfaces opposite to the upper working surface 23 and/or the lower working surface 22 comprising a cooling system arranged in correspondence with each die respectively. The cooling system may comprise cooling channels for circulation of cold water or any other cooling fluid in order in order to avoid or at least reduce heating of the forming tool or to provide an extra cooling to forming tool.

In examples, the press system 20 may be provided with a blank holder 25 configured to hold a blank and to positioning the blank onto the lower die 22. The blank holder may also be provided with a one or more biasing elements configured to bias the blank holder to a position at a predetermined distance from the lower die 22.

A first post-operation tool 30 configured to perform trimming and/or piercing operations may be provided. The first post-operation tool 30 may be arranged downstream of the press tool 20. The first post-operation tool 30 may comprise upper 32 and lower 31 mating dies. The first post-operation tool upper and lower mating dies may comprise die block adapted to operate at different temperatures corresponding to the zones of the blank which are to obtain different microstructures and mechanical properties which have been created or are pre-prepared in upstream tools.

A side of the upper die 32 opposite to the upper working surface 33 may be fastened to the upper body 3 and a side of the lower die 31 opposite to the lower working surface 34 may be fastened to the lower body 2. The dies may comprise one or more knives or cutting blades (not shown) arranged on the working surfaces.

The die blocks adapted to achieve lower temperature "cold blocks" i.e. corresponding to the "hard zone" at the blank may also comprise one or more electrical heaters or channels conducting hot liquid and temperature sensors to control the temperature of the dies. The sensors may be thermocouples. In some examples, it is preferable to maintain the temperature of the area of the blank corresponding to the cold blocks ("hard zone") at or near a predetermined temperature e.g. above 200° C.

It has been found that at or near 200° C. the strength of the blanks may be around 800 MPa which may be the limit in order to avoid damage at the knives or cutting blades. The control may be an on-off control although some other controls in order to maintain the temperature may also be implemented.

These cold blocks may also be cooled with a cooling liquid e.g. water and/or air passing through channels provided in the block.

In this example, the blocks adapted to achieve higher temperature i.e. corresponding to the "soft zone" at the blank may do not have implemented a heating or cooling device. In some other examples, these blocks may already be pre-heated at the correct temperature due to previous blanks located onto the blocks.

In examples, the first post-operation tool 30 may be provided with a blank holder (not shown) configured to hold a blank and to positioning the blank onto the lower die 31.

The temperature of the area of the blank corresponding to the hot blocks ("soft zone") may start the operation of the first post-operation tool 30 at a temperature at or near 650° C. Once the operation of the first post-operation tool 30 is finished, the temperature at the soft zone of the blank may be at or near 590° C. In some examples, not heating or cooling devices may be implemented corresponding to the soft zone.

A second post-operation tool 40 may be provided. The second post-operation tool 40 may also be configured to perform trimming and/or piercing operations. The second post-operation tool 40 may be arranged downstream of the first post-operation tool 30. The second post-operation tool 40 may comprise an upper mating die 42 and a lower mating die 41. The upper mating die 42 may comprise an upper working surface 43 and the lower mating die 41 may comprise a lower working surface 44. Both working surfaces in use may face the blank to be hot formed. The working surfaces may be uneven, e.g. they may comprise protruding portions or recesses.

The dies at the press tool 40 may have a different temperature than the blank to be hot formed, thus the expansion may be taken into account. This way, the dies may be 2% longer than the blank to be hot formed in order to balance.

A side of the upper die 42 opposite to the working surface 43 may be fastened to the upper body 3. A side of the lower die 41 opposite to the working surface 44 is fastened to the lower body 2.

The dies may comprise one or more knives or cutting blades arranged on the working surfaces.

In some examples, an adjusting device (not shown) configured to adjust the distance between the upper 42 and lower 41 dies may be provided. This way, to extent to which the blank located between the upper 42 and lower 41 dies may be deformed in use along the working surfaces of each upper and lower die can be adjusted.

Once the adjustment of the distance between the upper 42 and lower dies 41 in order to deform (and thus calibrate the blank) is performed, the tolerances of the hot formed blank may be improved. In some examples, the blank to be hot formed may have an area with a non-optimized thickness e.g. greater thickness in one part of the blank than in some other part, thus the thickness has to be optimized.

With this arrangement of uneven working surfaces, the distance at selected portions of the working surfaces (e.g. near a radius in the blank) may be adjusted at or near the area with a non-optimized thickness, thus the material may be deformed i.e. forced to flow to zones adjacent to the area with a non-optimized thickness, thus a constant thickness along the blank may be achieved.

In examples, the adjusting device may be controlled based on a sensor system configured to detect the thickness of the blank.

In some examples, the second post-operation tool 40 may be provided with a blank holder (not shown) configured to hold a blank and to positioning the blank onto the lower die 41. The blank holder may also be provided with a one or more biasing elements configured to bias the blank holder to a position at a predetermined distance from the lower die.

In further examples, other ways of adapting the dies of the tools to operate at lower or higher temperatures may also be foreseen.

It should be understood that although the figures describe dies having a substantially square or rectangular shape, the blocks may have any other shape and may even have partially rounded shapes.

In all examples, temperature sensors and control systems in order to control the temperature may be provided in any tools. The tools may also be provided with cooling plates, blanks holders, etc.

An automatic transfer device (not shown) e.g. a plurality of industrial robots or a conveyor may also be provided to perform the transfer of blanks between the tools.

FIGS. 2*a*-2*d* schematically illustrate a sequence of situations occurring during the performance of a method for cooling down a blank according to an example. Same reference numbers denote the same elements. The method is described below with reference to the sequences of situations illustrated by FIGS. 2*a*-2*d*.

Figure 2A:
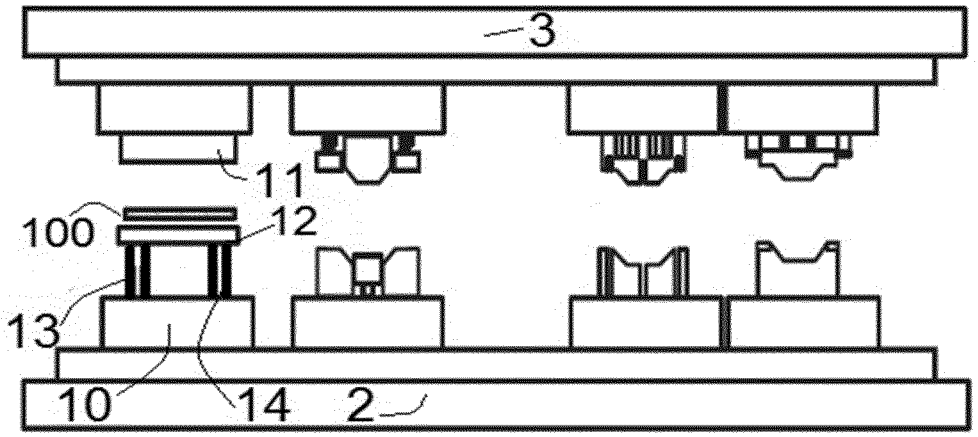
FIGS. 2*a*-2*d* schematically illustrate a sequence of situations occurring during the performance of a method for cooling down a blank according to an example.

For the sake of simplicity, references to angles may also be included in descriptions relating to FIG. 2*a* (and further figures). The references to angles may be used to indicate approximate positions of the upper body with respect to the lower body. Thus, for example, reference may be made to that the upper body is at 0° position with respect to the lower body which indicates that the upper body is in the highest position with respect to the lower body and 180° to indicate that the upper body is in the lowest position (full contact position) with respect to the lower body. 360° then refers again to the upper body being in the highest position.

In FIG. 2*a*, a blank 100 to be hot formed may be made of an Ultra High Strength Steel (UHSS). In this particular example, the UHSS may be 22MnB5 boron steel although some other boron steels may be used. In some examples, the 22MnB5 may contain approximately 0.23% C, 0.22% Si, and 0.16% Cr. The material may further comprise Mn, Al, Ti, B, N, Ni in different proportions.

The composition of Usibor® which is one of the steels that could be used is summarized below in weight percentages (rest is iron (Fe) and impurities):

| C | Si | Mn | P | S | Cr | Ti | B | N |
|---|---|---|---|---|---|---|---|---|
| 0.24 | 0.27 | 1.14 | 0.015 | 0.001 | 0.17 | 0.036 | 0.003 | 0.004 |

It has been found that such 22MnB5 steels may have an Ac3 transformation point (austenite transformation point, hereinafter, referred to as "Ac3 point") at or near 880° C. The Ac1 (first temperature at which austenization starts at heating, hereinafter, referred to as "Ac1 point") at or near 720° C. The Ms transformation point (martensite start temperature, hereinafter, referred to as "Ms point") may be at or near 410° C. The Mf transformation point (martensite finish temperature, hereinafter, referred to as "Mf point") may be at or near 230° C.

The blank 100 may be heated in in a heating device (not shown) e.g. a furnace. This way, the blank 100 may be heated to a temperature higher than Ac3. Thus, the heating may be performed to a temperature above 880° C.

Once the blank 100 is heated to the desired temperature, the blank 100 may be transferred to the cooling/heating tool 10. This may be performed by an automatic transfer device (not shown) e.g. a plurality of industrial robots or a conveyor. The period of time to transfer the blank between the furnace (not shown) and the cooling/heating tool 10 in some examples may be between 2 and 3 seconds.

In some examples, a centering station comprising e.g. pins and/or guiding devices may be provided upstream from with the cooling/heating tool, thus the blank may be properly centered.

The upper die 11 and the lower die 12 of the cooling/heating tool may be formed by two or more die blocks comprising one or more working surfaces that in use face the blank.

Furthermore, the upper die may also comprise hot die blocks (not shown). The hot die blocks may comprise a heating source in order to be adapted to achieve higher temperatures ("hot block").

Additionally, the upper and lower dies may include one or several "cold" blocks. These cold blocks may be cooled with cold water and/or by cooling air passing through channels provided in the block.

The structure and operation of the hot blocks and cold blocks may be the same as mentioned with reference to FIG. 1.

With this arrangement, at least one die block of the cooling/heating tool may be heated up, thus the different microstructures and mechanical properties of the blank 100 in the area in contact with the heated block ("soft zone") may be changed.

In this way, the soft zone may have enhanced ductility, while the strength of the parts next to the soft zone may be maintained. The microstructure of the soft zone may be modified and the elongation in the soft zone may be increased.

The press upper body 3 may be located at an open position (0° position) using the press mechanism. The blank 100 may be placed between the upper die 11 and the lower die 12. As commented above, the blank 100 may be made e.g. of a boron steel, coated or uncoated, such as e.g. Usibor®. During deformation, parts of the blank may be quenched, for example by passing cold water through channels provided in some of the die blocks. Selected portions of the blank can thus obtain a predetermined microstructure by cooling down faster than other portions.

In some examples, the blank may be placed on a blank holder. The lower die 12 may be displaced at a predetermined distance with respect the lower body 2 using a first lower biasing element 13 and a second lower biasing element 14.

As commented above, the biasing elements may comprise, for example, a spring e.g. a mechanical spring or a gas spring although some other biasing elements may be possible e.g. hydraulic mechanism. The hydraulic mechanism may be a passive or an active mechanism.

This way, the lower die 12 (and thus the blank 100 located on the lower die 12) may be situated at a first predetermined position (a position where the lower die may be contacted between 90° and 150° by the upper die) from the lower body 2.

Figure 2B:
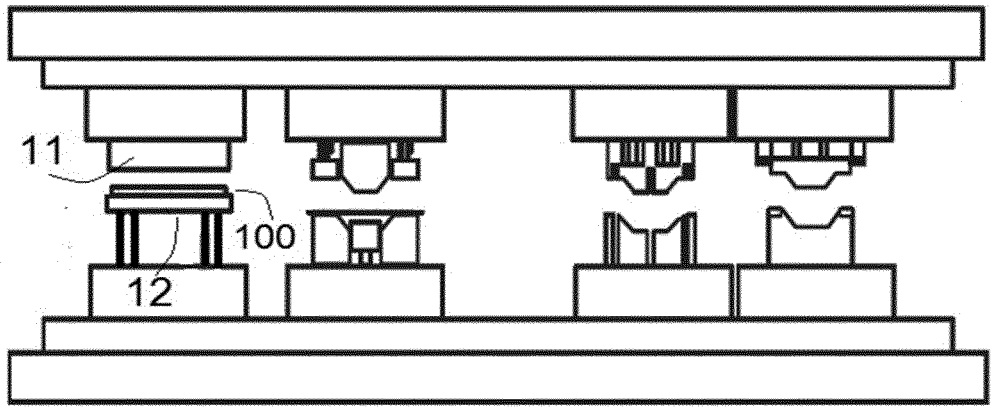

In FIG. 2*b*, the press is shown with a downwards press progression of the mobile upper body with respect to the fixed lower body, thus the upper die 11 may be moved towards the lower die 12 (and thus the blank located on the lower die).

The upper die 11 may contact the blank 100 placed between the cooling/heating tool upper die 11 and the cooling/heating tool lower die 12 at the first predetermined position (between 90° and 150° position).

Figure 2C:
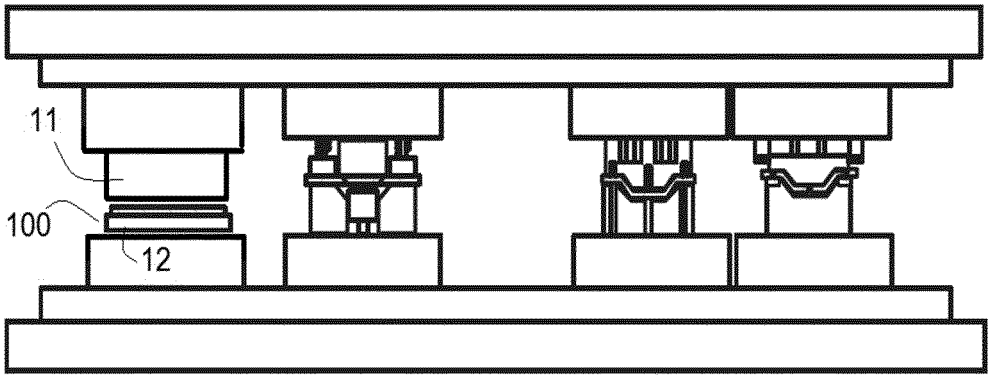

In FIG. 2*c*, once the blank is contacted between 90° and 150° positions, the upper die 11 may start to cool down and heat the blank 100 at the corresponding zones. Heating in this sense does not necessarily mean that the temperature of the warmer portion is actually increased from its initial temperature, but rather that the temperature is maintained or slows down at a relatively low rate. By pressing the blank, the first lower biasing element and the second lower biasing element may be deformed until a final desired position (180° position) to cool down and heat up the blank 100 at the corresponding zones is reached.

Figure 2D:
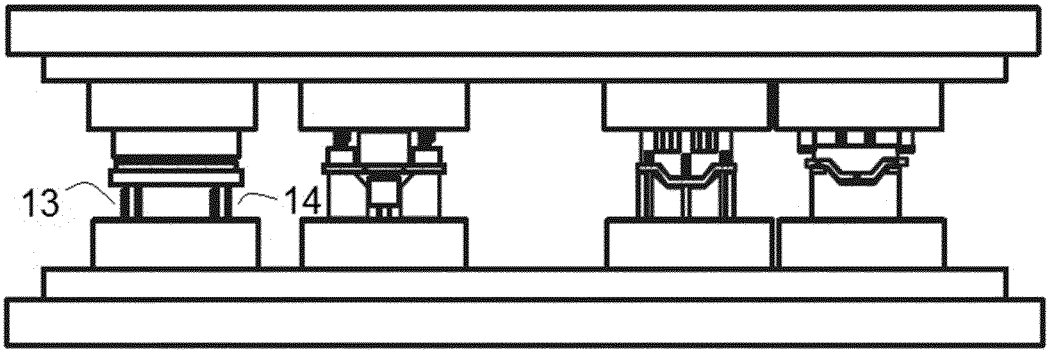

In FIG. 2*d*, once the final desired position (180° position) is reached, an upwards press progression of the upper body by the press mechanism may be provided. The last contact between the upper die and the blank may be between 210° and 270° position of the upper body (and thus the upper die) with respect to the lower body. The first lower biasing element 13 and the second lower biasing element 14 may return to their original position i.e. be extended. This way, the period of time since the blank 100 is contacted for the first time by upper die and the last contact i.e. the time that the blank is heated and/or cooled may be between 0.33 and 1 second.

It has already been stated that the blank 100 may be previously heated to a temperature above 880° C. The blank may be transferred to the cooling/heating tool 10, thus during the transfer period the temperature may be reduced to between 750° C. and 850° C. With this arrangement, the blank 100 may be placed at the cooling/heating tool 10 when it has a temperature of between 750° C. and 850° C. The blank may then be cooled down to a temperature at or near 570° C. at the zones of the blank corresponding to the blocks adapted to operate at a lower temperature ("hard zones"). At the same time, portions of the blank may be kept above a temperature around 740° C. at the zones of the blank corresponding to the blocks adapted to operate at a higher temperature ("soft zones"). This may lead to a cooling rate of e.g. at or near 500° C. for the hard zone. The cooling rate for the soft zone may be below 25° C./s, preferably at or near 15° C./s.

With the cooling/heating tool 10 integrated in the press system 3, the time in order to cool down/or maintain portions of the blank at a higher temperature (and thus create soft zones) may be optimized since an extra movement as known from prior art systems in order to transfer the blank from an external cooling/heating tool configured to create soft zones may be avoided. It also may be time saving. Furthermore, the movements of the blank between the tools may be limited, and thus the temperature and cooling rates of the different portions of the blank are more easily controlled.

FIGS. 2*e*-2*h* schematically illustrate a sequence of situations occurring during the performance of a method for drawing a blank according to an example. Same reference numbers denote the same elements. The method is described below with reference to the sequences of situations illustrated by FIGS. 2*e*-2*h*.

Figure 2E:
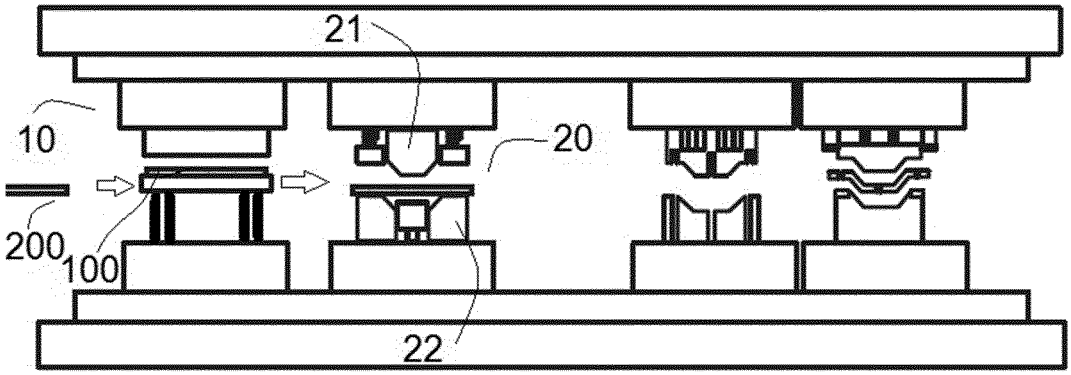
FIGS. 2*e*-2*h* schematically illustrate a sequence of situations occurring during the performance of a method for drawing the same blank according to an example.

In FIG. 2*e*, the blank 100 may already be provided with zones at different temperatures, thus the blank 100 may be ready to be transferred from the cooling/heating tool 10 to the press tool 20. The press tools 20 may also be referred to as "forming tool" or "drawing tool".

The transfer may be performed by an automatic transfer device (not shown) e.g. a plurality of industrial robots or a conveyor.

As commented above, the blank may be transferred having a temperature around 570° C. at the zones corresponding to the blocks adapted to operate at a lower temperature (hard zones). Due to the transfer time, the zones of the blank 100 corresponding to the blocks adapted to operate at a lower temperature may be cooled down to approximately 550° C. At the same time, the zones of the blank 100 corresponding to the blocks adapted to operate at a higher temperature (soft zones) may be around 750° C. when exiting the cooling tool. Again, due to the transfer time, the zones of the blank 100 corresponding to the blocks adapted to operate at a higher temperature may be cooled down at or near 730° C.

The blank 100 may be positioned by the transfer device onto the lower die 22 of the press tool using a blank holder. In some examples, the distance of the blank holder with respect to the press lower die 22 may be regulated using a one or more biasing elements.

While the blank 100 is being transferred or positioned onto the lower die 22, the automatic transfer system may be operated to provide a blank 200 to the cooling/heating tool 10. As a result, the cooling/heating tool 10 may start the operation in order to cool down the blank 200. This operation may be performed as stated before. Furthermore, this operation may be performed at the same time as the drawing or forming operation on blank 100 of the press tool 20.

This way, the press upper body 3 may be located again at an open position (0° position) using the press mechanism. The blank 100 may be placed between the press tool upper die 21 and the press tool lower die 22.

Figure 2F:
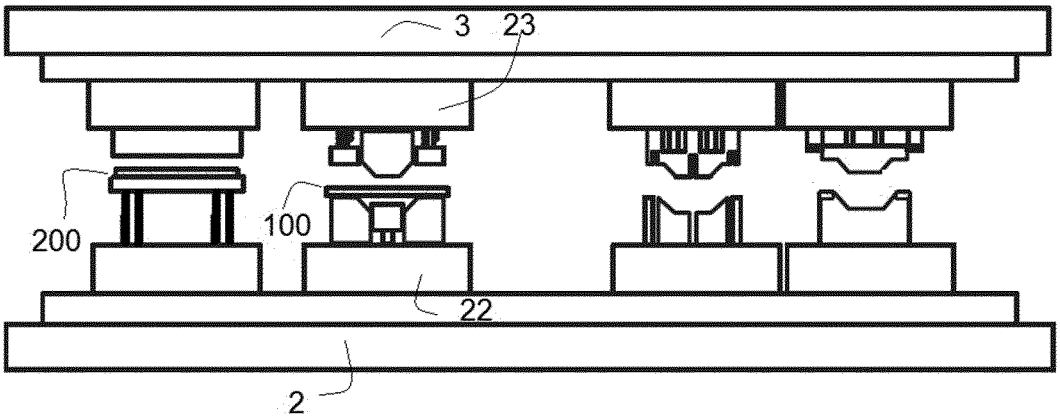
Figure 2G:
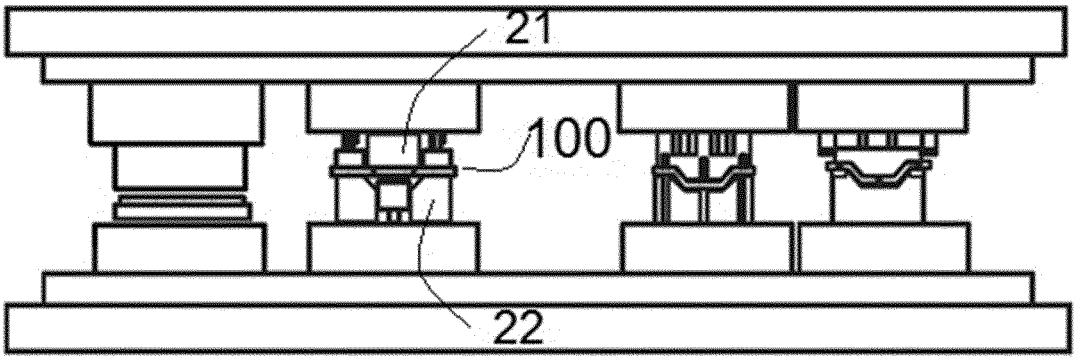

In FIG. 2*f*, the press 1 may be provided with a downwards press progression of the mobile upper body 3 with respect to the fixed lower body 2, thus the upper die 21 may be moved towards the lower die 22.

In this example, the press tool upper 21 and lower 22 dies may be provided with two or more die blocks (not shown) adapted to operate at a different temperature. The blocks may correspond to the zones of the blank with different temperatures created during the operation of the cooling/heating tool 10. The structure and operation of the blocks at the cooling/heating tool may be the same as mentioned above, In FIG. 2*g*, the upper die 21 may contact the blank 100 placed between the press tool upper die 21 and the press tool lower die 22 approximately at 180° position. Once the blank is contacted, the upper die 21 may start to press and draw the blank 100.

Figure 2H:
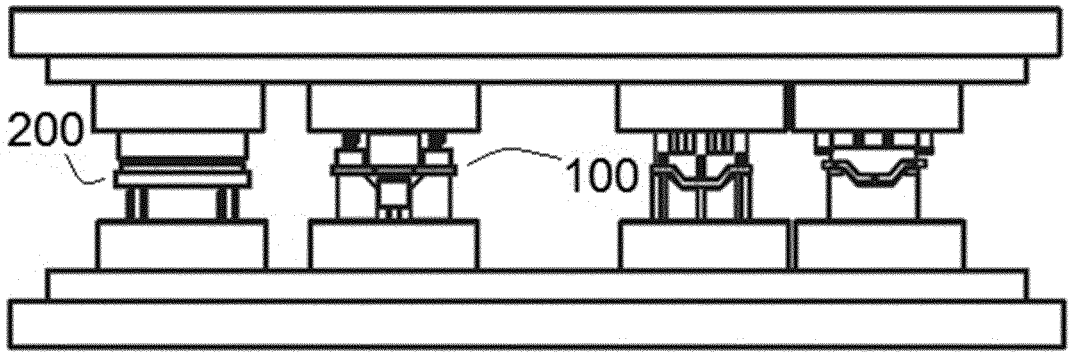

In FIG. 2*h*, once the final desired position is reached (approximately at 180°), an upwards press progression may be provided. The last complete contact between the working surface of the upper die of the forming tool and the blank (and thus the end of the drawing operation) may be between 180° and 210° position. The last contact between the blank and blank holder may be between for example 210°-270°.

The press tool may be provided with a cooling system as previously commented. The cooling system may be controlled by a controller, thus the temperature of the blank 100 may be reduced to a desired temperature and at a selected speed. During the operation of the press tool 20, the temperature of the blank 100 at the zones corresponding to the blocks operated at a lower temperature (hard zones) may be reduced until a temperature at or near 300° C. is reached.

The zones corresponding to the blocks operated at a lower temperature may be provided with an optimized number of heaters. This way, the temperature of the blank 100 at the zones corresponding to the blocks operated at a lower temperature may be maintained at or near 300° C.

In this particular example, heaters and or cooling devices may not be required at the blocks adapted to operate at a higher temperature. This is because the blocks operated at a higher temperature may have been heated by the operation at previous blanks, thus the blocks may keep the correct temperature. In alternative examples, heaters and coolers could be provided for temperature control Due to the drawing process, the temperature at the zones corresponding to the blocks operated at a higher temperature may be reduced from approximately 730° C. until a temperature at or near 670° C. is reached.

FIGS. 2*i*-2*l* schematically illustrate a sequence of situations occurring during the performance of a method for piercing and/or trimming the same blank according to an example. Same reference numbers denote the same elements. The method is described below with reference to the sequences of situations illustrated by FIGS. 2*i*-2*l*.

Figure 2I:
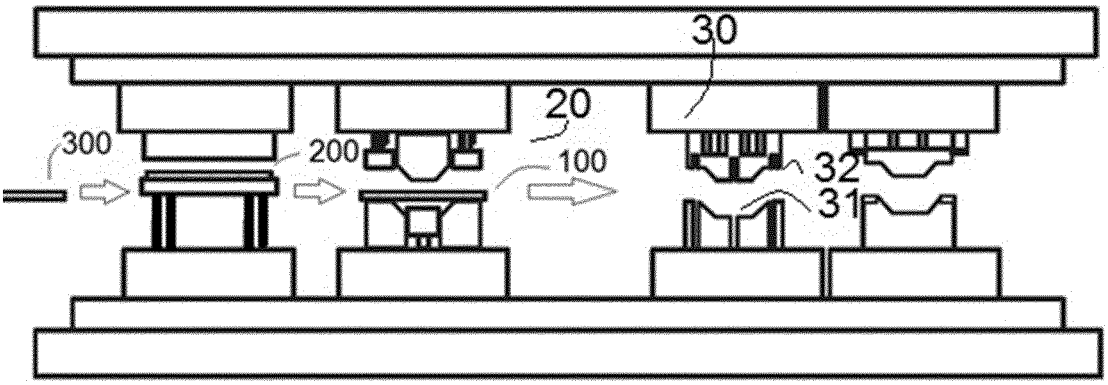
FIGS. 2*i*-2*l* schematically illustrate a sequence of situations occurring during the performance of a method for piercing and/or trimming the same blank according to an example.

In FIG. 2*i*, the blank 100 has already been drawn, thus the blank 100 may be ready to be transferred from the press tool 20 to the first post-operation tool 30 e.g. piercing or trimming operations tool. The transferring may be performed by an automatic transfer device (not shown) e.g. a plurality of industrial robots or a conveyor. As commented above, the blank 100 may leave the press tool 20 and it may be transferred at a temperature at or near 300° C. (at the zones of the blank corresponding to the blocks adapted to operate at a lower temperature) and a temperature at or near 670° C. (at the zones of the blank corresponding to the blocks adapted to operate at a higher temperature).

Due to the transfer time, the blank 100 may be cooled down at or near 280° C. (at the zones of the blank corresponding to the blocks adapted to operate at a lower temperature) and a temperature at or near 590° C. (at the zones of the blank corresponding to the blocks adapted to operate at a higher temperature), thus the blank is placed at the first post-operation tool at those temperatures. The blank 100 may be placed onto the lower die 31 and between the lower die 31 and the upper die 32.

The blocks adapted to operate at a lower temperature may comprise a heating device e.g. heaters and/or channels with a hot fluid, thus the temperature at the corresponding zones of the blanks may be maintained above 200° C.

It has been found that the temperature of the zones of the blank corresponding to the cold blocks is preferably maintained above 200° C. This way, the strength of the steel is kept around 800 MPa which is the maximum strength possible in order to perform piercing and trimming operations avoiding damage at the blades.

Figure 2J:
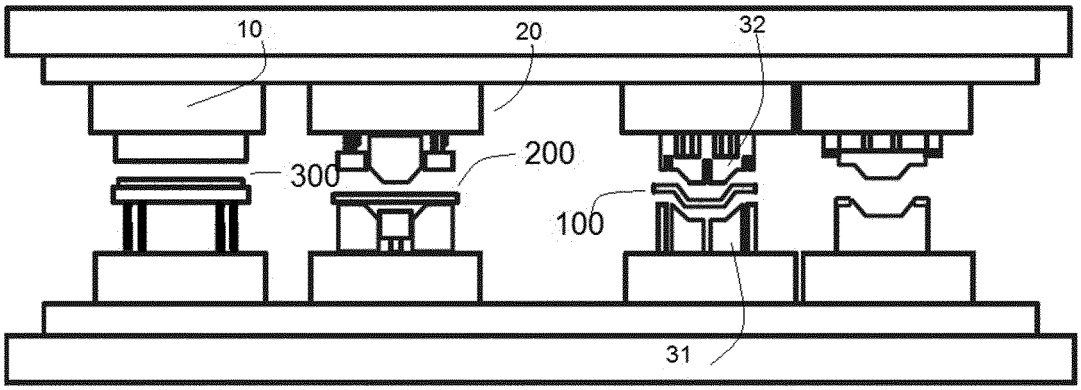

In FIG. 2*j*, as the blank 100 is transferred or positioned onto the lower die 31, the automatic transfer system may be operated to transfer the blank 200 from the cooling station to the press tool 20 and to provide a further blank 300 to the cooling/heating tool 10. As a result, the cooling/heating tool 10 may start the operation of cooling the blank 300 as commented above. At the same time, the press tool 20 may start the operation in order to draw and the blank 200 as also commented above, whereas blank 100 undergoes a first post-operation.

The press upper body 32 may be located at an open position (0° position) using the press mechanism. The press 1 may be provided with a downwards press progression of the mobile upper body 3 with respect to the fixed lower body 2, thus the upper die 32 may be moved towards the lower die 31.

Figure 2K:
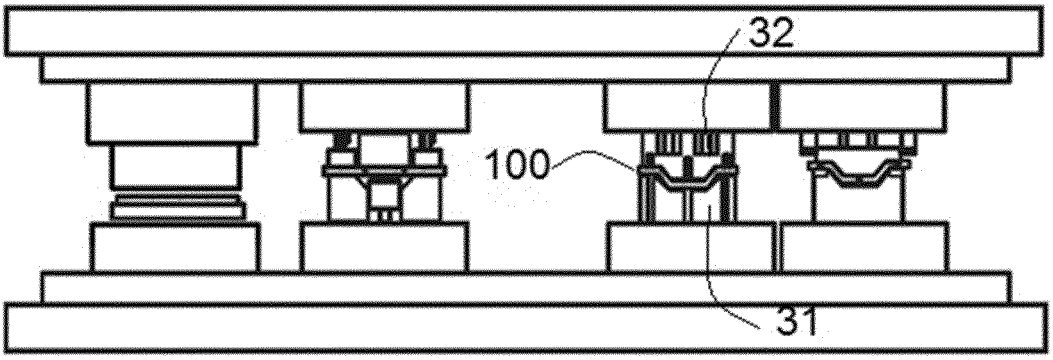

In FIG. 2*k*, the upper die 32 may contact the blank 100 placed between the press tool upper die 32 and the press tool lower die 31 until the final desired position (at or near 180°) is reached.

While the press is in contact with the blank 100, a piercing operation may be performed using the cutting blades or some other cutting element. Once the piercing operation is finished, a trimming operation may be performed. In alternative examples, the trimming operation may be performed first and the trimming operation may be performed once the trimming operation is finished.

While the blank 100 undergoes a post-operation, the zones of the blank corresponding to the blocks adapted to operate at a lower temperature may be heated up and/or cooled down by using the equipment already commented before.

This way, the temperature of zones of the blank 100 corresponding to the blocks adapted to operate at a lower temperature may be maintained above 200° C. With this arrangement, the strength of the blank may be maintained at reasonable values in order to be pierced and/or trimmed.

In this example, the blocks adapted to operate at a higher temperature (corresponding to the soft zones at the blank) do not need to be provided with heating or cooling devices. These blocks may have already been heated by the operation at previous blocks at the correct temperature, thus the heating or cooling devices may not be necessary.

Figure 2L:
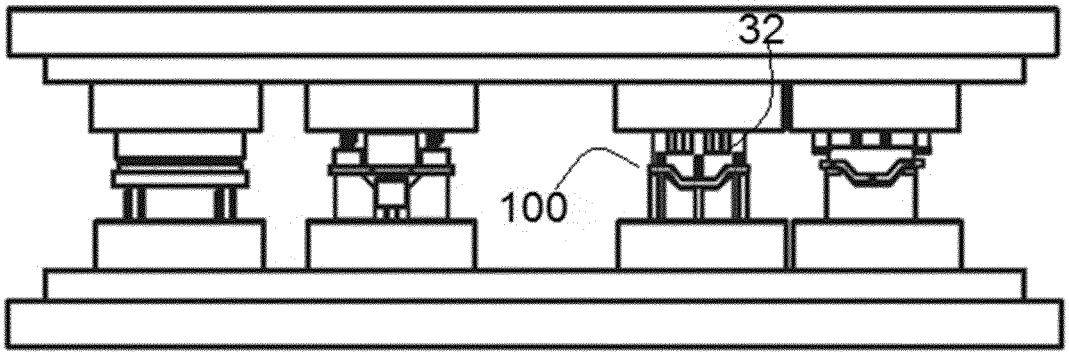

In FIG. 2*l*, once the final desired position (180° position) is reached, an upwards press progression may be provided. The last complete contact between the working surface of the upper die 32 and the blank 100 (and thus the end of the operation) may be between 180° and 210° position. The last contact between blank and blank holder may occur between 210° and 270°.

FIGS. 2*m*-2*p* schematically illustrate a sequence of situations occurring during the performance of a method for further piercing and/or trimming a blank according to an example. Same reference numbers denote the same elements. The method is described below with reference to the sequences of situations illustrated by FIGS. 2*m*-2*p*.

Figure 2M:
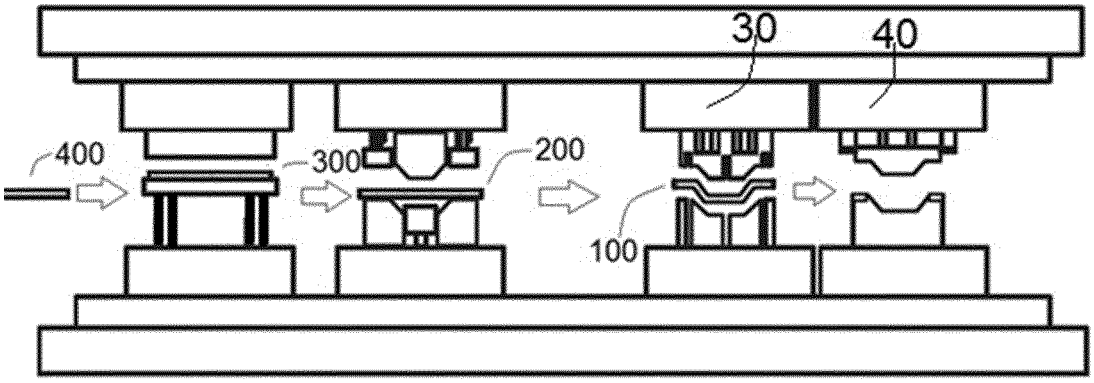
FIGS. 2*m*-2*p* schematically illustrate a sequence of situations occurring during the performance of a method for further piercing and/or trimming the same blank according to an example.

In FIG. 2*m*, the blank 100 may be transferred from the first post-operation tool 30 to the second post-operation tool 40 e.g. piercing, trimming and calibration tool. The transferring may be performed by an automatic transfer device (not shown) e.g. a plurality of industrial robots or a conveyor. As previously commented, the blank 100 may leave the first post-operation tool 30 and it may be transferred with a temperature of around 200° C. for the hard zones and a temperature around 590° C. for the soft zones.

Figure 2N:
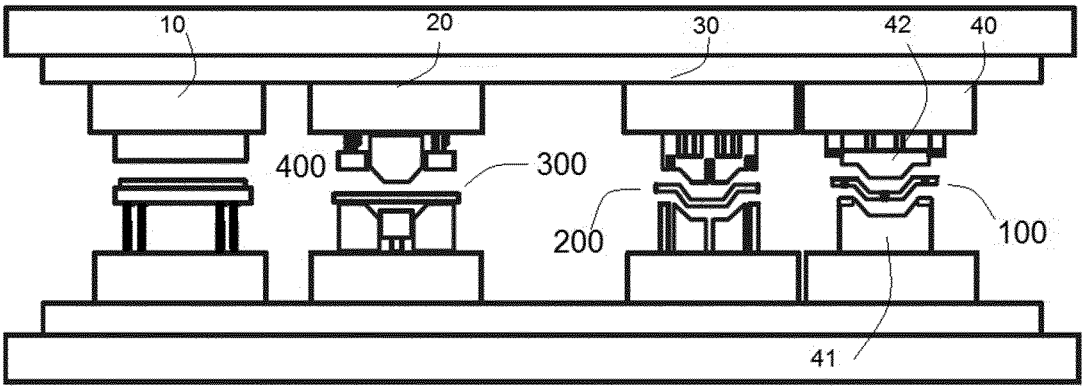

In FIG. 2*n*, the blank 100 may be placed onto the lower die 41, for example using a blank holder. The blank may be located between the lower die 41 and the upper die 42.

As the blank 100 is being transferred or positioned onto the lower die 41, the automatic transfer system may transfer the blank 200 from the drawing tool to the first post-operation tool 30, the blank 300 is transferred to the press tool 20 and a further blank 400 is transferred to the cooling/heating tool 10. As a result, the cooling/heating tool 10 may operate on blank 400. At the same time, the press tool 20 draws blank 300 and the first post-operation tool 30 may start its operation on blank 200 respectively. The tool's operation may be the same as previously commented. Simultaneously, blank 100 undergoes a second post-operation.

Figure 2O:
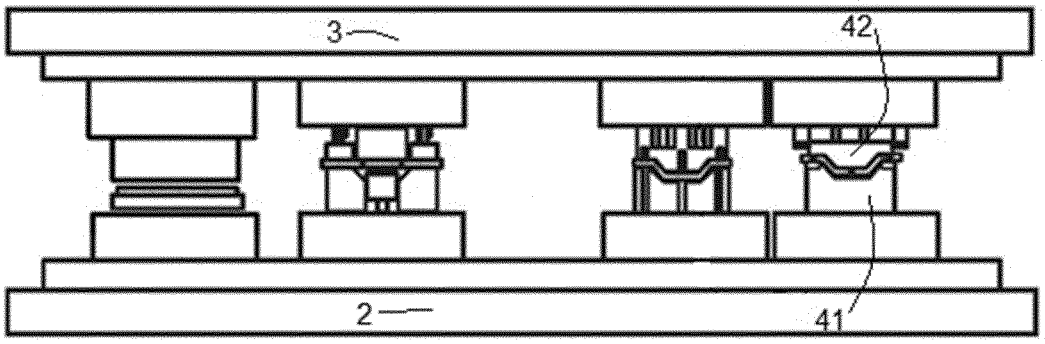

In FIG. 2*o*, the press upper body 42 may be located at an open position (0° position) using the press mechanism. The press 1 may be provided with a downwards press progression of the mobile upper body 3 with respect to the fixed lower body 2, thus the upper die 42 may be moved towards the lower die 41. The upper die 42 may contact the blank placed between the upper die 41 and lower die 42 at the final desired position (at or near 180° of the upper die with respect of the lower body).

While the press is in contact with the blank 100, piercing operation may be performed using the cutting blades. Once the piercing operation is finished, a trimming operation may be performed. In alternative examples, the trimming operation may be performed first and the trimming operation may be performed once the trimming operation is finished.

Additionally, a calibration operation may be performed, thus the tolerance of the blank may be improved. This way, the distance between the upper die 42 and the lower die 41 may be adjusted using an adjusting device. The adjusting device may be controlled based on a sensor system (not shown) configured to detect the thickness of the blank 100. Following the example, the blank may be pressed by the upper 42 and lower 41 dies, thus a constant thickness of the blank may be achieved.

Once the operation of the second post-operation tool is finished, the blank 100 may be transferred and hardened at a room temperature.

Figure 2P:
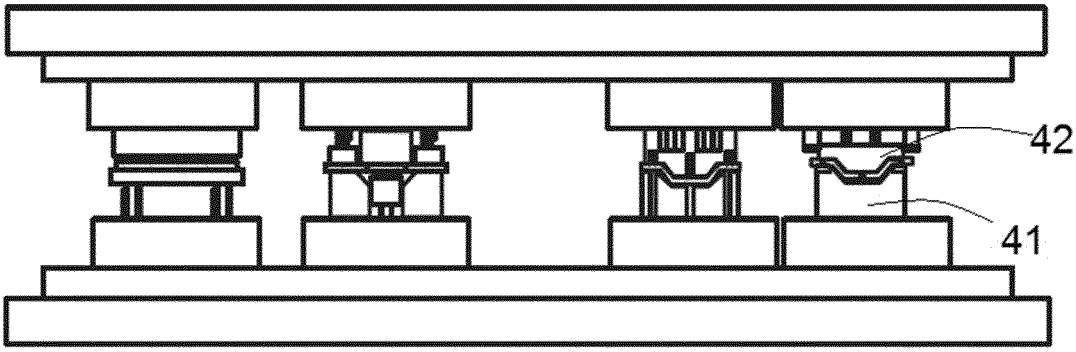

In FIG. 2*p*, once the final desired position (180° position) is reached, an upwards press progression may be provided.

Once the open position (0° position) is reached by the press by applying the upwards movement, the blank 100 may be transferred and hardened at a room temperature. At the same time, the automatic transfer system may be operated to provide a blank 500 to the cooling/heating tool 10, the blank 200 to the second post-operation tool 40, the blank 300 to the first post-operation tool 30 and the blank 400 to the press tool 20. As a result, all the tools may start their operations as previously commented.

In some examples, depending on the shape of the blank 100, further drawing and other operations e.g. piercing and/or trimming may be provided In further examples, the order of post-operations may be interchanged (e.g. first cutting, then calibrating or vice versa).

For reasons of completeness, various aspects of the present disclosure are set out in the following numbered clauses:

Clause 1. A press system for manufacturing hot formed structural components, the system comprising a fixed lower body, a mobile upper body and a mechanism configured to provide upwards and downwards press progression of the mobile upper body with respect to the fixed lower body, wherein the system comprises:

a cooling/heating tool configured to cool down and/or heat selected portions of a previously heated blank such that selected portion can obtain locally different microstructures and mechanical properties which comprises:

upper and lower mating dies, each cooling die being formed by two or more die blocks comprising one or more working surfaces that in use face the blank, and the upper and lower dies comprising two or more die blocks adapted to operate at different temperatures corresponding to zones of the blank having locally different microstructures and mechanical properties, and a press tool configured to draw the blank, wherein the press tool is arranged downstream the cooling/heating tool and comprises:

upper and lower mating dies, each pressing die comprising one or more working surfaces that in use face the blank, and the upper pressing die is fastened to the upper body and the lower pressing die is fastened to the lower body, and a blank transfer mechanism to transfer the blank from the cooling/heating tool to the press tool.

Clause 2. A system according to clause 1, wherein the cooling/heating tool lower die is connected to the lower body with one or more lower biasing elements configured to bias the lower die to a position at a predetermined first distance from the lower body and/or the cooling/heating tool upper die is connected to the upper body with one or more upper biasing elements configured to bias the upper die to a position at a predetermined second distance from the upper body, Clause 3. A system according to any of clauses 1-2, wherein the blocks adapted to operate at a higher temperature comprise one or more electrical heaters.

Clause 4. A system according to clause 3, wherein the heaters are configured to be activated independently.

Clause 5. A system according to any of clauses 1-4, wherein the blocks adapted to operate at a higher temperature comprise channels conducting a hot liquid.

Clause 6. A system according to any of clauses 1-5, wherein the blocks adapted to operate at a lower temperature comprise channels conducting cooling liquid and/or air.

Clause 7. A system according to any of clauses 1-6, wherein the press tool upper and lower mating dies further comprise two or more die blocks adapted to operate at different temperatures corresponding to the zones of the blank having locally different microstructures and mechanical properties Clause 8. A system according to clause 7, wherein the die blocks of the press tool adapted to operate at a higher temperature comprise one or more electrical heaters.

Clause 9. A system according to clause 8, wherein the heaters can be activated independently.

Clause 10. A system according to any of clauses 7-9, the blocks adapted to operate at a higher temperature comprise channels conducting a hot liquid.

Clause 11. A system according to any of clauses 7-10, wherein the blocks adapted to operate at a lower temperature comprise channels conducting cooling liquid and/or air.

Clause 12. A system according to any of clauses 1-11, further comprising a first post-operation tool configured to perform trimming and/or piercing operations, wherein the first post-operation tool is arranged downstream of the press tool and comprises:

upper and lower mating first post-operation tool dies, each die comprising one or more working surfaces that in use face the blank and, the upper first post-operation tool die is fastened to the upper body and the lower first post-operation tool die is fastened to the lower body, and the first post-operation tool dies comprising one or more cutting blades arranged on the working surfaces, and the blank transfer mechanism is further configured to transfer the blank from the press tool to the first post-operation tool.

Clause 13. A system according to clause 12, wherein the first post-operation tool upper and lower mating dies further comprise die blocks adapted to operate at different temperatures corresponding to the zones of the blank having locally different microstructures and mechanical properties.

Clause 14. A system according to clause 13, wherein the die blocks of the first post-operation tool are adapted to operate at a lower temperature comprise one or more electrical heaters.

Clause 15. A system according to clause 14, wherein the heaters can be activated independently.

Clause 16. A system according to any of clauses 13-15, wherein the die blocks of the first post-operation tools adapted to operate at a lower temperature comprise channels conducting a hot liquid.

Clause 17. A system according to any of clauses 13-16, wherein the die blocks of the first post-operation tool adapted to operate at a lower temperature comprise channels conducting cooling liquid and/or air.

Clause 18. A system according to any of clauses 1-11 or 13-17, wherein a temperature of the cooling/heating tool blocks and/or press tool blocks and/or first post-operation tool blocks is configured to be regulated based on a temperature measured at the blocks.

Clause 19. A system according to clause 18 wherein the blocks comprise one or more thermocouples configured to measure the temperature of the blocks.

Clause 20. A system according to any of clauses 12-19, further comprising a second post-operation tool configured to perform trimming and/or piercing operations, wherein the second post-operation tool is arranged downstream of the first post-operation tool and comprises:

upper and lower mating second post-operation tool dies, each die comprising one or more working surfaces that in use face the blank and, the upper second post-operation tool die opposite is fastened to the upper body and the lower second post-operation tool die is fastened to the lower body, and the dies comprising one or more cutting blades arranged on the working surfaces, and the blank transfer mechanism is further configured to transfer the blank from the first post-operation tool to the second post-operation tool.

Clause 21. A system according to clause 20, wherein the second post-operation tool comprises an adjusting device configured to adjust the distance between the upper and lower dies so as to deform the blank located in use at the second post-operation tool along the working surface of each upper and lower die, wherein the adjusting device is controlled based on a sensor system configured to detect the thickness of the blank.

Clause 22. A method for heating up and cooling down a blank comprising:

Providing a press system according to any of clauses 1-21;

Providing a blank to be hot formed made of an Ultra High Strength Steel (UHSS);

Heating the blank;

Locating the press upper body at an open position using the press mechanism;

Placing the blank between the cooling/heating tool upper and lower mating dies;

cooling down at least selected portions of the blank by providing a downwards press progression of the mobile upper body with respect the fixed lower body so as the upper die is moved towards the lower die until a final desired position with respect to the fixed lower body for pressing the blank including Operating at least two die blocks at different temperatures corresponding to zones of the blank to be formed having locally different microstructures and mechanical properties, wherein blocks of a higher temperature are arranged with respect to the blank such that their working surface is configured to enter into contact with a portion of the blank in which a soft zone is to be formed.

Clause 23. A method according to clause 22, wherein before placing the blank, the blank is centered at a centering station.

Clause 24. A method according to any of clauses 22-23, wherein the UHSS comprises approximately 0.23% C, 0.22% Si, and 1.18% Mn.

Clause 25. A method according to clause 24, wherein the UHSS further comprises Al, Ti, B, Cr, Ni, N.

Clause 26. A method according to any of clauses 22-25, wherein the blank is heated to at least an austenization temperature of 880° C.

Clause 27. A method according to any of clauses 22-26, wherein the cooling/heating tool blocks adapted to operate at a lower temperature cool down the corresponding zones of the blank to between 650 and 450° C.

Clause 28. A method according to clause 27, wherein the cooling/heating tool blocks adapted to operate at a lower temperature cool down the corresponding zones of the blank to between 550 and 500° C.

Clause 29. A method according to any of clauses 22-28, wherein the blocks adapted to operate at a higher temperature cool down the blank to between 800 and 650° C.

Clause 30. A method according to any of clauses 22-29, wherein the blocks adapted to operate at a higher temperature cool down the blank at a rate below 25° C./s.

Clause 31. A method for drawing a blank comprising a method according to any of clauses 22-30 further comprising:

Transferring the blank from the cooling/heating tool to the press tool,

Placing the blank between the press tool upper and lower dies;

Drawing the blank by providing a downwards press progression of the mobile upper body with respect the fixed lower body until a final desired position with respect to the press fixed lower body for pressing the structural component is reached.

Clause 32. A method according to clause 31 when dependent on clause 6, further comprising operating at least two die blocks at different temperatures corresponding to zones of the blank to be formed having locally different microstructures and mechanical properties.

Clause 33. A method according to clause 32, wherein press tool blocks adapted to operate at a lower temperature maintain the temperature of the blank between 320 and 280° C.

Clause 34. A method for piercing and/or trimming a blank comprising a method according to any of clauses 31-33 when dependent on clause 12 further comprising:

Transferring the blank from the press tool to the first post-operation tool,

Placing the structural component to be formed between the first post-operation tool upper and lower mating dies;

Providing a downwards press progression of the press mobile upper body with respect to the press fixed lower body until the final desired position with respect to the press fixed lower for pressing the blank is reached;

Cutting and/or punching the blank using the cutting blades of the first post-operation tool.

Clause 35. A method according to clause 34 dependent on clause 13, further comprising before cutting and/or punching the blank operating at least two die blocks of the first post-operation tool at different temperatures corresponding to zones of the blank to be formed having locally different microstructures and mechanical properties.

Clause 36. A method according to claim 35, wherein the die blocks adapted to operate at a lower temperature maintain the temperature of the corresponding blank zones above 200° C.

Clause 37. A method for further piercing and/or trimming and calibrating a hot formed structural component to be formed comprising a method according to any of clauses 34-36 when dependent on clause 20 further comprising:

Transporting the structural component from the first post-operation tool to the second post-operation tool;

Providing a downwards press progression of the press mobile upper body with respect to the press fixed lower body until the final desired position for pressing the structural component is reached;

Cutting and/or punching the structural component using the cutting blades;

Adjusting the distance between the upper and lower dies so as to deform the structural component to be formed along the working surface of each upper and lower die;

Clause 38. A hot formed structural component as obtainable by the method according to any of clauses 22-39.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A press system for manufacturing hot formed structural components, the system comprising a fixed lower body, a mobile upper body and a mechanism configured to provide upwards and downwards press progression of the mobile upper body with respect to the fixed lower body, wherein the system comprises:

a cooling/heating tool, configured to cool down and/or heat selected portions of a previously heated blank such that the selected portions can obtain locally different microstructures and mechanical properties, which comprises:

upper and lower mating cooling/heating dies, each cooling/heating die being formed by two or more die blocks comprising one or more working surfaces that in use face the blank, the upper cooling/heating die is fastened to the mobile upper body and the lower cooling/heating die is fastened to the fixed lower body, and the upper and lower dies comprising two or more die blocks adapted to operate at different temperatures corresponding to zones of the blank to be formed having locally different microstructures and mechanical properties, and a press tool configured to draw the blank, wherein the press tool is arranged downstream the cooling/heating tool and comprises:

upper and lower mating pressing dies, each pressing die comprising one or more working surfaces that in use face the blank, and the upper pressing die is fastened to the upper body and the lower pressing die is fastened to the lower body, and a blank transfer mechanism to transfer the blank from the cooling/heating tool to the press tool.

2. The system according to claim 1, wherein the cooling/heating tool lower die is fastened to the lower body with one or more lower biasing elements configured to bias the lower die to a position at a predetermined first distance from the lower body and/or the cooling/heating tool upper die is fastened to the upper body with one or more upper biasing elements configured to bias the upper die to a position at a predetermined second distance from the upper body.

3. The system according to claim 1, wherein the block(s) adapted to operate at a higher temperature comprise one or more electrical heaters and/or channels conducting a hot liquid.

4. The system according to claim 1, wherein the block(s) adapted to operate at a lower temperature comprise channels conducting cooling liquid and/or air.

5. The system according to claim 1, wherein the press tool upper and lower mating dies further comprise two or more die blocks adapted to operate at different temperatures corresponding to the zones of the blank to be formed having locally different microstructures and mechanical properties.

6. The system according to claim 5, wherein the block(s) of the press tool upper and lower mating dies adapted to operate at a higher temperature comprise one or more electrical heaters and/or channels conducting a hot liquid.

7. The system according to claim 1, further comprising a first post-operation tool configured to perform trimming and/or piercing operations, wherein the first post-operation tool is arranged downstream of the press tool and comprises:

upper and lower mating first post-operation tool dies, each die comprising one or more working surfaces that in use face the blank, and the upper first post-operation tool die is fastened to the upper body and the lower first post-operation tool die is fastened to the lower body, and the first post-operation tool dies comprising one or more knives or cutting blades arranged on the one or more working surfaces, and the blank transfer mechanism is further configured to transfer the blank from the press tool to the first post-operation tool.

8. The system according to claim 7, wherein the first post-operation tool upper and lower mating dies further comprise die blocks adapted to operate at different temperatures corresponding to the zones of the blank to be formed having locally different microstructures and mechanical properties.

9. The system according to claim 7, further comprising a second post-operation tool configured to perform trimming and/or piercing operations, wherein the second post-operation tool is arranged downstream of the first post-operation tool and comprises:

upper and lower mating second post-operation tool dies, each die comprising one or more working surfaces that in use face the blank, and the upper second post-operation tool die is fastened to the upper body and the lower second post-operation tool die is fastened to the lower body, and the second post operation tool dies comprising one or more knives or cutting blades arranged on the one or more working surfaces, and the blank transfer mechanism is further configured to transfer the blank from the first post-operation tool to the second post-operation tool.

10. A method for heating up and cooling down a blank comprising:

Providing a press system according to claim 1;

Providing a blank to be hot formed made of an Ultra High Strength Steel (UHSS);

Heating the blank;

Locating the press upper body at an open position using the press mechanism;

Placing the blank between the cooling/heating tool upper and lower mating dies;

cooling down at least selected portions of the blank by providing a downwards press progression of the mobile upper body with respect the fixed lower body so as the upper die is moved towards the lower die until a final desired position with respect to the fixed lower body for pressing the blank including Operating at least two die blocks of the cooling/heating tool at different temperatures corresponding to zones of the blank to be formed having locally different microstructures and mechanical properties, wherein blocks of a higher temperature are arranged with respect to the blank such that their working surface is configured to enter into contact with a portion of the blank in which a soft zone is to be formed.

11. A method for drawing a blank comprising a method according to claim 10 further comprising:

Transferring the blank from the cooling/heating tool to the press tool;

Placing the blank between the press tool upper and lower dies;

Drawing the blank by providing a downwards press progression of the mobile upper body with respect the fixed lower body until a final desired position with respect to the press fixed lower body for pressing the structural component is reached.

12. The method according to claim 11, wherein the press tool upper and lower mating dies further comprise two or more die blocks adapted to operate at different temperatures corresponding to the zones of the blank to be formed having locally different microstructures and mechanical properties, and the method further comprises operating at least two press tool die blocks at different temperatures corresponding to the zones of the blank to be formed having locally different microstructures and mechanical properties.

13. A method for piercing and/or trimming a blank comprising a method according to claim 11, wherein the press system further comprises a first post-operation tool configured to perform trimming and/or piercing operations, wherein the first post-operation tool is arranged downstream of the press tool and comprises:

upper and lower mating first post-operation tool dies, each die comprising one or more working surfaces that in use face the blank and, the upper first post-operation tool die is fastened to the upper body and the lower first post-operation tool die is fastened to the lower body, and the first post-operation tool dies comprising one or more knives or cutting blades arranged on the one or more working surfaces, and the blank transfer mechanism is further configured to transfer the blank from the press tool to the first post-operation tool;

wherein the method further comprises:

Transferring the blank from the press tool to the first post-operation tool;

Placing the structural component to be formed between the first post-operation tool upper and lower mating dies;

Providing a downwards press progression of the press mobile upper body with respect to the press fixed lower body until the final desired position with respect to the press fixed lower body for pressing the blank is reached;

Cutting and/or punching the blank using the one or more knives or cutting blades of the first post-operation tool.

14. The method according to claim 13, wherein the first post-operation tool upper and lower mating dies further comprise die blocks adapted to operate at different temperatures corresponding to the zones of the blank to be formed having locally different microstructures and mechanical properties, and the method further comprises before cutting and/or punching the blank, operating at least two die blocks of the first post-operation tool at different temperatures corresponding to the zones of the blank to be formed having locally different microstructures and mechanical properties.

15. A method for further piercing and/or trimming and calibrating a hot formed structural component to be formed comprising a method according to claim 13, wherein the press system further comprises a second post-operation tool configured to perform trimming and/or piercing operations, wherein the second post-operation tool is arranged downstream of the first post-operation tool and comprises:

upper and lower mating second post-operation tool dies, each die comprising one or more working surfaces that in use face the blank and, the upper second post-operation tool die is fastened to the upper body and the lower second post-operation tool die is fastened to the lower body, and the second post-operation tool dies comprising one or more knives or cutting blades arranged on the one or more working surfaces, and the blank transfer mechanism is further configured to transfer the blank from the first post-operation tool to the second post-operation tool;

wherein the method further comprises:

Transporting the structural component from the first post-operation tool to the second post-operation tool;

Placing the structural components to be formed between the second post-operation tool upper and lower mating dies;

Providing a downwards press progression of the press mobile upper body with respect to the press fixed lower body until the final desired position for pressing the structural component is reached;

Cutting and/or punching the structural component using the one or more knives or cutting blades;

Adjusting the distance between the upper and lower dies so as to deform the structural component to be formed along the working surface of each upper and lower die.

* * * * *